US011220648B2

(12) United States Patent
Choi et al.

(10) Patent No.: US 11,220,648 B2
(45) **Date of Patent: *Jan. 11, 2022**

(54) FUEL COMPOSITIONS FOR CONTROLLING COMBUSTION IN ENGINES

(71) Applicant: ExxonMobil Research and Engineering Company, Annandale, NJ (US)

(72) Inventors: Eugine Choi, Flemington, NJ (US); Matthew W. Boland, Pittsburgh, PA (US); Zhisheng Gao, Flemington, NJ (US); Luca Salvi, Haddonfield, NJ (US); Shamel Merchant, Bridgewater, NJ (US); Bruce W. Crawley, Oxfordshire (GB)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 211 days.

This patent is subject to a terminal disclaimer.

(21) Appl. No.: 16/777,955

(22) Filed: Jan. 31, 2020

(65) Prior Publication Data

US 2021/0238492 A1 Aug. 5, 2021

Related U.S. Application Data

(63) Continuation of application No. 15/788,917, filed on Oct. 20, 2017, now Pat. No. 10,550,344.

(Continued)

(51) Int. Cl.

| | |
|---|---|
| ***C10L 10/10*** | (2006.01) |
| ***C10L 1/02*** | (2006.01) |
| ***C10L 1/16*** | (2006.01) |

(52) U.S. Cl.

CPC ..... *C10L 10/10* (2013.01); *C10L 1/023* (2013.01); *C10L 1/1691* (2013.01); (Continued)

(58) Field of Classification Search

CPC ..... C10L 10/10; C10L 1/023; C10L 1/1691; C10L 2200/0423; C10L 2270/023; C10L 2290/24; C10L 1/06

See application file for complete search history.

(56) References Cited

U.S. PATENT DOCUMENTS 6,187,171 B1 * 2/2001 Tsuboi ..... C10L 1/06 208/16

2004/0129608 A1 * 7/2004 Clark ..... C10G 25/003 208/307

(Continued)

*Primary Examiner* — Ali Z Fadhel

(74) *Attorney, Agent, or Firm* — Robert A. Migliorini

(57) ABSTRACT

Naphtha boiling range compositions are provided that can have improved combustion properties (relative to the research octane number of the composition) in spark ignition engines and/or compression ignition engines. The improved combustion properties can be achieved by controlling the total combined amounts of n-paraffins and isoparaffins that include a straight-chain propyl group ($R_1$—$CH_2$—$CH_2$—$CH_2$—$R_2$). For such a straight-chain propyl group, $R_2$ can correspond to any convenient $C_xH_y$ group that can appear in a paraffin or isoparaffin. $R_1$ can correspond to a hydrogen atom, making the straight-chain propyl group a terminal n-propyl group; or $R_1$ can correspond to any convenient $C_xH_y$ group that can appear in a paraffin or isoparaffin.

20 Claims, 5 Drawing Sheets

Related U.S. Application Data

(60) Provisional application No. 62/422,085, filed on Nov. 15, 2016.

(52) U.S. Cl.
CPC . *C10L 2200/0423* (2013.01); *C10L 2270/023* (2013.01); *C10L 2290/24* (2013.01)

(56) References Cited

U.S. PATENT DOCUMENTS

| | | | | |
|---|---|---|---|---|
| 2006/0106266 | A1* | 5/2006 | Broutin | C10L 1/06 585/418 |
| 2008/0134571 | A1* | 6/2008 | Landschof | C10L 1/06 44/424 |
| 2015/0184095 | A1* | 7/2015 | Landschof | F02B 43/02 123/1 A |
| 2016/0178469 | A1* | 6/2016 | Berkhous | G01N 33/22 73/23.31 |

* cited by examiner

FUEL COMPOSITIONS FOR CONTROLLING COMBUSTION IN ENGINES

CROSS-REFERENCE TO RELATED APPLICATIONS

This application is a continuation application filed under 37 C.F.R. 1.53(b) of parent application serial number U.S. Ser. No. 15/788,917, filed on Oct. 20, 2017, the entirety of which is hereby incorporated herein by reference, which claims the benefit of U.S. Provisional Application No. 62/422,085, filed on Nov. 15, 2016, the entire contents of which are incorporated herein by reference.

FIELD

Fuel compositions with improved ignition properties and methods for making such fuel to compositions are provided.

BACKGROUND

Spark ignition engines can have improved operation when operated with a fuel that provides a sufficient ignition delay so that the start of combustion is substantially controlled by the introduction of a spark into the combustion chamber. Fuels that do not have a sufficient ignition delay for an engine can cause "knocking" in the engine, where at least part of the combustion in the engine is not dependent on the introduction of the spark into the combustion chamber.

Traditionally, fuels for spark ignition engines have been characterized based on use of octane ratings. A common method for characterizing the octane rating of a fuel is to use an average of the Research Octane Number (RON) and the Motor Octane Number (MON) for a composition. (RON+MON/2). This type of octane rating can be used to determine the likelihood of "knocking" behavior when operating a conventional spark ignition engine.

Another type of characterization of a fuel for a spark ignition engine is the sensitivity of the fuel, which is defined as (RON−MON). Some previous methods for selecting fuels with longer ignition delays at a given value of RON have involved selecting fuels with lower values of the sensitivity.

SUMMARY

In various aspects, naphtha boiling range fuel compositions are provided. The fuel compositions can have a research octane number (RON) of at least about 80 and can comprise a combined wt % of n-paraffins and isoparaffins that include a straight-chain propyl group, the wt % being based on the total weight of the naphtha boiling range fuel composition. In some aspects, the combined wt % of n-paraffins and isoparaffins that include a straight-chain propyl group can be less than (−1.273×RON+135.6). In other aspects, the combined wt % of n-paraffins and isoparaffins that include a straight-chain propyl group can be greater than (−1.273×RON+151.8). Optionally, the fuel composition has a T5 distillation point of at least about 10° C. and a T95 distillation point of about 233° C. or less. Optionally, the fuel composition can have an RON of about 80 to about 99, or about 75 to about 105, or about 88 to about 101. Optionally, the fuel composition can have a sensitivity (RON−MON) of about 5.0 to about 12.0, or about 8.0 to about 18.0, or about 5.0 to about 10.0.

In various aspects, methods for making a naphtha boiling range composition are provided. The methods can include forming a modified naphtha boiling range composition by adding a modifier composition to a first naphtha boiling range composition, the first naphtha boiling range composition having a research octane number (RON) of at least about 80. Optionally, the modified naphtha boiling range composition can have a RON that differs from the RON of the first naphtha boiling range composition by 5.0 or less (or 3.0 or less, or 1.0 or less). Optionally, an ignition delay of the modified naphtha boiling range composition can be greater than an ignition delay of the first naphtha boiling range composition by at least 1.0 milliseconds. In some aspects, a combined wt % of n-paraffins and isoparaffins that include a straight-chain propyl group in the first naphtha boiling range composition can be greater than (−1.273×RON+139.6), and the combined wt % of n-paraffins and isoparaffins that include a straight-chain propyl group in the modified naphtha boiling range composition can be less than (−1.273×RON+139.6), or less than (−1.273×RON+135.6). In other aspects, a combined wt % of n-paraffins and isoparaffins that include a straight-chain propyl group in the first naphtha boiling range composition can be less than (−1.273×RON+147.8), and the combined wt % of n-paraffins and isoparaffins that include a straight-chain propyl group in the modified naphtha boiling range composition can be greater than (−1.273×RON+147.8), or greater than (−1.273×RON+151.8). Optionally, the first naphtha boiling range composition can have a RON of about 80 to about 99, or about 82 to about 98, or about 84 to about 96. Additionally or alternately, the modified naphtha boiling range composition can optionally have a RON of about 75 to about 105, or about 88 to about 101. Optionally, the first naphtha boiling range composition and/or the modified naphtha boiling range composition can have a T5 distillation point of at least about 10° C. and a T95 distillation point of about 233° C. or less, or a T5 of at least about 15° C. and a T95 of about 215° C. or less, or a T5 of at least about 15° C. and a T95 of about 204° C. or less.

DETAILED DESCRIPTION

Overview

Figure 1:
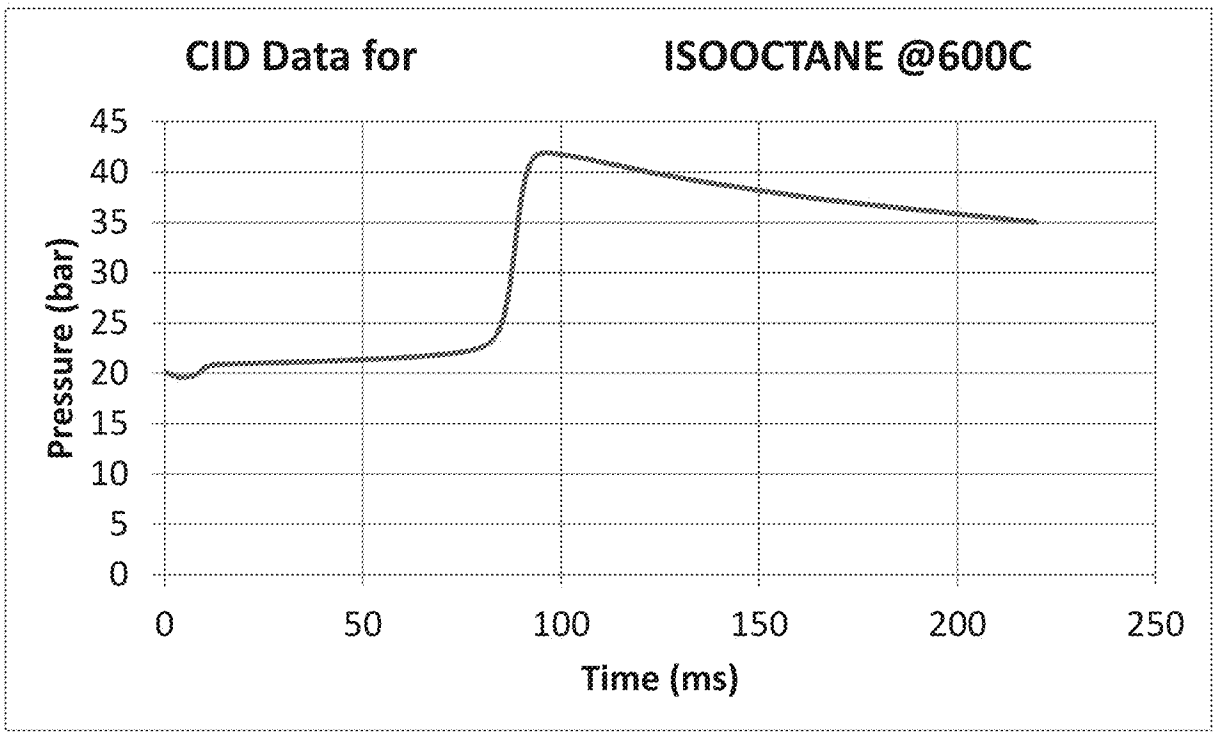
FIG. 1 shows a pressure versus time curve for determining ignition delay according to ASTM D7668 for iso-octane.

In some aspects, naphtha boiling range compositions are provided that can have improved combustion properties (relative to the research octane number of the composition) in spark ignition engines. In other aspects, naphtha boiling range compositions are provided that can have improved combustion properties (relative to the research octane number of the composition) in compression ignition engines. The improved combustion properties for both types of naphtha boiling range compositions can be achieved by controlling the total combined amounts of n-paraffins and isoparaffins that include a straight-chain propyl group ($R_1$—$CH_2$—$CH_2$—$CH_2$—$R_2$). For such a straight-chain propyl group, $R_2$ can correspond to any convenient $C_xH_y$ group that can appear in a paraffin or isoparaffin. $R_1$ can correspond to a hydrogen atom, making the straight-chain propyl group a terminal n-propyl group; or $R_1$ can correspond to any convenient $C_xH_y$ group that can appear in a paraffin or isoparaffin.

A common method for characterizing the octane rating of a composition is to use an average of the Research Octane Number (RON) and the Motor Octane Number (MON) for a composition. This type of octane rating can be used to determine the likelihood of "knocking" behavior when operating a conventional spark ignition engine. In this discussion and the claims below, octane rating is defined as (RON+MON)/2, where RON is research octane number and MON is motor octane number. Research Octane Number (RON) is determined according to ASTM D2699. Motor Octane Number (MON) is determined according to ASTM D2700.

While this type of characterization of naphtha boiling range compositions is suitable for conventional spark ignition engines, it has unexpectedly been discovered that an alternative characterization method can be valuable for identifying naphtha boiling range fuel compositions with improved knock resistance at a given research octane rating. In particular, the alternative characterization method can allow for identification of naphtha boiling range fuel compositions that have an unexpectedly long ignition delay relative to the research octane number for the composition. Such naphtha boiling range compositions with increased knock resistance can be beneficial, for example, for use in spark ignition engines that are operated at higher temperature and/or higher pressure than typical spark ignition engines. Turbo charged spark ignition engines and downsized spark ignition engines are examples of spark ignition engines that can operate at higher temperature and/or pressure than conventional spark ignition engines. Additionally, the alternative characterization method can also be used to identify naphtha boiling range fuel compositions with a reduced or minimized ignition delay relative to the research octane number. Such naphtha boiling range compositions can be beneficial for use in advanced combustion engines that operate based on compression ignition. Examples of advanced combustion engines include, but are not limited to, homogenous charge compression ignition (HCCI) engines and pre-mixed charge compression ignition (PCCI) engines.

Internal combustion engines can typically be characterized as corresponding to one of two types of engines. In spark-ignited internal combustion engines, a mixture of fuel and air is compressed without causing ignition or combustion of the air/fuel mixture based just on compression. A spark is then introduced into the air fuel mixture to start combustion at a desired timing. Fuels for use in spark-ignited internal combustion engines are often characterized based on an octane rating, which is a measure of the ability of a fuel to resist combustion based solely on compression. The octane rating is valuable information for a spark-ignited engine, as the octane rating indicates what type of engine timings may be suitable for use with a given fuel.

The other typical type of engine is a compression ignition engine. In compression ignition, a mixture of air and fuel is provided into a cylinder which is compressed. When a sufficient amount of compression occurs, the mixture of air and fuel combusts. This combustion occurs without the need to introduce a separate spark to ignite the air/fuel mixture. A fuel for a compression ignition engine can be characterized based on a cetane number, which is a measure of how quickly a fuel will ignite. Most conventional compression ignition engines use kerosene and/or diesel boiling range compositions as fuels. However, some compression ignition engines, such as HCCI and PCCI engines, can use naphtha boiling range compositions as fuels.

Both octane rating (such as RON) and cetane rating or cetane number are values that can provide some indication of the ignition delay of a fuel composition. Octane rating is typically used for spark ignition engines, where increased ignition delay is desirable. "Knocking" occurs in a spark ignition when the peak of the combustion process does not occur at the desired or optimum moment for the stroke cycle of the engine. Typically this can be due to a portion of the fuel/air mixture combusting prior to encountering the spark and/or the combustion front initiated by a spark. A fuel composition with an increased ignition delay, when used in a spark ignition engine, can correspond to a fuel composition with an increased knock resistance. Cetane number is typically used for compression ignition engines, where a reduced ignition delay can be beneficial. In compression ignition, the fuel/air mixture combusts when a sufficient combination of temperature and pressure is present within a fuel chamber during a compression stroke. A fuel composition with a reduced ignition delay can ignite under a less severe combination of temperature and pressure.

Although RON is typically used to characterize naphtha boiling range fuel compositions, it has been discovered that RON is only partially correlated with the ignition delay for a fuel composition. The average of RON and MON is also only partially correlated. As a result, the knock resistance and/or ignition delay for a fuel is not well characterized based on RON. It has further been unexpectedly discovered that an improved correlation with ignition delay can be provided based on use of RON in combination with the weight percentage of combined n-paraffins and isoparaffins in a composition that have straight-chain propyl groups.

For fuels intended for use in spark ignition engines, it has been unexpectedly determined that fuel compositions satisfying Equation (1) can provide increased knock resistance (and/or increased ignition delay) relative to the RON for the fuel composition:

$$Wt\% \text{ of } (n\text{-paraffins+isoparaffins}) \text{ with straight-chain propyl group} < -1.273 \times RON + 135.6 \quad (1)$$

The wt % in Equation (1) is based on the total weight of the (naphtha boiling range) fuel composition. In some aspects, the relationship in Equation (1) can be satisfied for a naphtha boiling range composition/fuel composition having any convenient RON and/or any convenient value of (RON+MON)/2. In particular, the relationships in Equations (1) can be satisfied for a fuel composition having an RON of about 80 to about 105, or about 80 to about 101, or about 80 to 99, or about 88 to about 101. In other aspects, the relationship in Equation (1) can be satisfied for a fuel composition having an RON of 101 or less, or 100 or less, or 99 or less, or 98 or less, or 97 or less, or 96 or less, or 95 or less, and/or at least 80, or at least 82, or at least 84, or at least 85, or at least 86, or at least 87, or at least 88. In particular, the relationship in Equation (1) can be satisfied for a fuel composition having an RON of about 88 to about 101, or about 80 to about 101, or about 82 to about 100, or about 84 to about 98. Additionally or alternately, the relationship in Equation (1) can be satisfied for a fuel composition having a value of (RON+MON)/2 of 99 or less, or 98 or less, or 97 or less, or 96 or less, or 95 or less, and/or at least 80, or at least about 82, or at least about 84, or at least 85, or at least 86, or at least 87, or at least 88. In particular, the relationships in Equation (1) can be satisfied for a fuel composition having a value of (RON+MON)/2 of about 80 to about 99, or about 82 to about 98, or about 84 to about 96.

Figure 4:
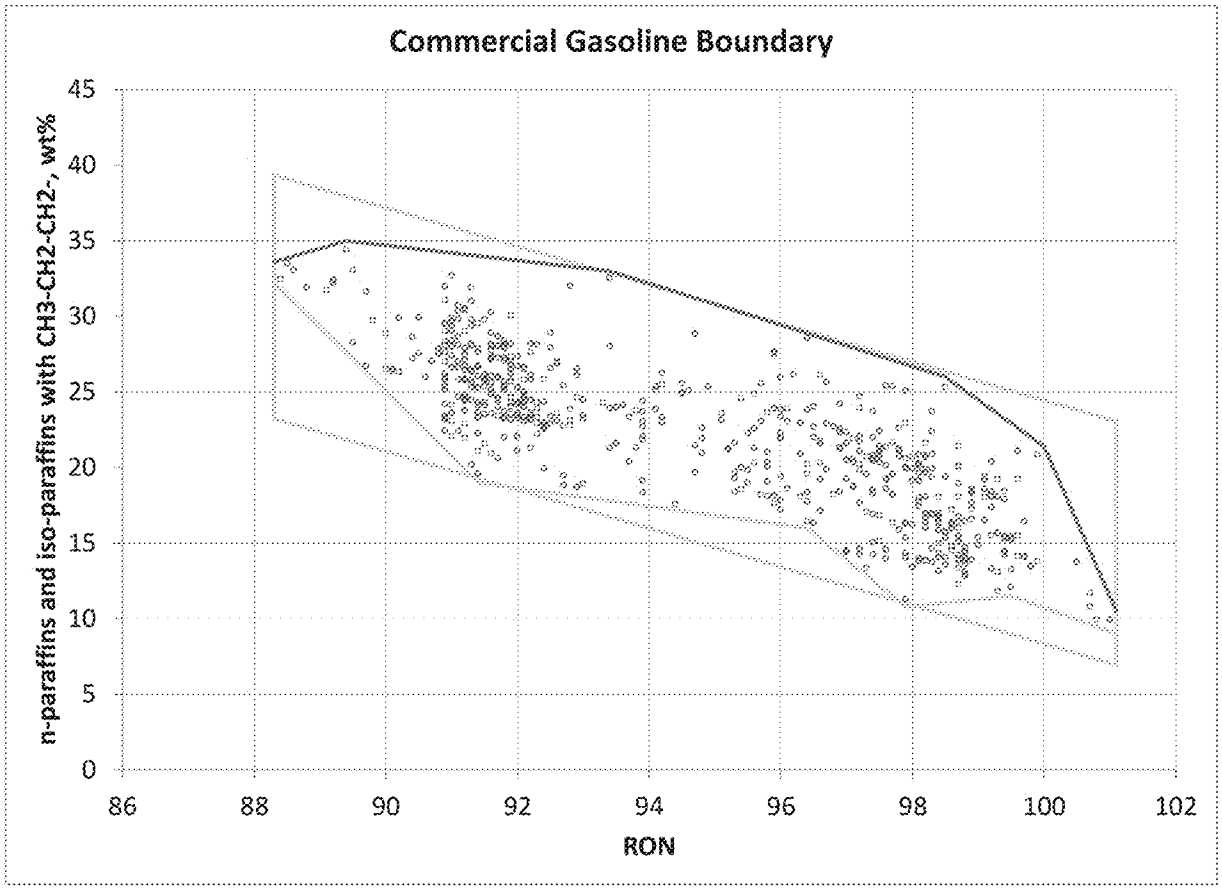
FIG. 4 shows a correlation between research octane number and content of combined n-paraffins and isoparaffins that include straight-chain propyl groups for various fuel compositions.

In some alternative aspects, a more detailed specification can be provided for a naphtha boiling range fuel composition for a spark ignition engine. In such alternative aspects, a series of inequalities (based on wt % relative to the total weight of the naphtha boiling range composition/fuel composition) can be used, depending on the RON value of the composition. The series of inequalities is specified in Table 1. The shape defined by this series of inequalities is shown in FIG. 4. Although the shape specified by Table 1 generally leads to lower wt % of paraffins and isoparaffins with straight-chain propyl groups as RON increases, it is noted that for RON values of 97.9-99.5, the wt % temporarily increases with increasing RON.

TABLE 1

Specification of a Knock Resistant Naphtha Boiling Range Composition

| RON Range | $C_{3+}$ wt % (straight-chain propyl in n-paraffin and isoparaffin) |
|---|---|
| 88.3 <= RON <= 91.4 | $C_{3+}$ wt % < 411.1 − 4.290 × RON (wt % 32.3 − 19.0) |
| 91.4 <= RON <= 96.4 | $C_{3+}$ wt % < 73.8 − 0.600 × RON (wt % 19.0 − 16.0) |
| 96.4 <= RON <= 97.9 | $C_{3+}$ wt % < 350.2 − 3.467 × RON (wt % 16.0 − 10.8) |
| 97.9 <= RON <= 99.5 | $C_{3+}$ wt % < −32.00 + 0.4375 × RON (wt % 10.8 − 11.5) |
| 99.5 <= RON <= 101.1 | $C_{3+}$ wt % < 167.0 − 1.563 × RON (wt % 11.5 − 9.0) |

For fuels intended for use in compression ignition engines, it has been unexpectedly determined that fuel compositions satisfying Equation (2) can provide a reduced ignition delay relative to the RON for the fuel composition:

$$Wt\% \text{ of } (n\text{-paraffins+isoparaffins}) \text{ with straight-chain propyl group} > -1.273 \times RON + 151.8 \quad (2)$$

In Equation (2), the wt % is based on the total weight of the naphtha boiling range composition/fuel composition. In some aspects, the relationship in Equation (2) can be satisfied for a fuel composition having any convenient RON and/or any convenient value of (RON+MON)/2. In particular, the relationships in Equation (2) can be satisfied for a fuel composition having an RON of about 75 to about 110, or about 78 to about 105, or about 80 to about 100, or about 88 to about 101. In other aspects, the relationship in Equation (2) can be satisfied for a fuel composition having an RON of 99 or less, or 98 or less, or 97 or less, or 96 or less, or 95 or less, and/or at least 75, or at least 77, or at least 78, or at least 80, or at least 82, or at least 84, or at least 85, or at least 86, or at least 87, or at least 88. In particular, the relationships in Equation (2) can be satisfied for a fuel composition having an RON of about 80 to about 99, or about 78 to about 98, or about 75 to about 96. Additionally or alternately, the relationships in Equation (2) can be satisfied for a fuel composition having a value of (RON+MON)/2 of 99 or less, or 98 or less, or 97 or less, or 96 or less, or 95 or less, and/or at least 75, or at least 77, or at least 78, or at least 80, or at least 82, or at least 84, or at least 85, or at least 86, or at least 87, or at least 88. In particular, the relationship in Equation (2) can be satisfied for a fuel composition having a value of (RON+MON)/2 of about 80 to about 99, or about 78 to about 98, or about 75 to about 96.

In some alternative aspects, a more detailed specification can be provided for a naphtha boiling range fuel composition for a compression ignition engine. In such alternative aspects, a series of inequalities (based on wt % relative to the total weight of the naphtha boiling range composition/fuel composition) can be used, depending on the RON value of the composition. The series of inequalities is specified in Table 2. The shape defined by this series of inequalities is shown in FIG. 4. Although the shape specified by Table 2 generally leads to lower wt % of paraffins and isoparaffins with straight-chain propyl groups as RON increases, it is noted that for RON values of 88.3-89.4, the wt % temporarily increases with increasing RON.

TABLE 2

Specification of a Naphtha Boiling Range Composition for Compression Engine

| RON Range | $C_{3+}$ wt % (straight-chain propyl in n-paraffin and isoparaffin) |
|---|---|
| 88.3 <= RON <= 89.4 | $C_{3+}$ wt % > −78.7 + 1.273 × RON (wt % 33.7 − 35.0) |
| 89.4 <= RON <= 93.4 | $C_{3+}$ wt % > 79.7 − 0.500 × RON (wt % 35.0 − 33.0) |
| 93.4 <= RON <= 98.5 | $C_{3+}$ wt % > 161.2 − 1.373 × RON (wt % 33.0 − 26.0) |
| 98.5 <= RON <= 100.0 | $C_{3+}$ wt % > 328.1 − 3.067 × RON (wt % 26.0 − 21.4) |
| 100.0 <= RON <= 101.1 | $C_{3+}$ wt % > 1012.3 − 9.909 × RON (wt % 21.4 − 10.5) |

A sensitivity of a fuel composition can also be defined based on the difference between the RON and the MON of the fuel composition. In some aspects, the sensitivity for a fuel composition can be less than about 18.0, or less than about 15.0, or less than about 12.0, or less than about 10.0, or less than about 9.0. In other aspects, the sensitivity can be at least about 2.0, or at least about 5.0, or at least about 6.0, or at least about 7.0, or at least about 8.0. In particular, the sensitivity can be about 5.0 to about 15.0, or about 8.0 to about 18.0, or about 5.0 to about 12.0, or about 5.0 to about 10.0.

Optionally, a fuel composition that satisfies either Equation (1) or Equation (2) can include at least 5 wt % naphthenes, or at least 10 wt % naphthenes; or a fuel composition that satisfies either Equation (1) or Equation (2) can include at least 5 wt % aromatics, or at least 10 wt % aromatics; or a combination thereof. In this discussion and the claims below, the amount of naphthenes and/or aromatics can be determined according to ASTM D5443.

In this discussion, the naphtha boiling range is defined as about 50° F. (−10° C., roughly corresponding to the lowest boiling point of a pentane isomer) to 450° F. (−233° C.). It is noted that due to practical consideration during fractionation (or other boiling point based separation) of hydrocarbon-like fractions, a fuel fraction formed according to the methods described herein may have a T5 or a T95 distillation point corresponding to the above values, as opposed to having initial/final boiling points corresponding to the above values. Compounds ($C_{4-}$) with a boiling point below the naphtha boiling range can be referred to as light ends. In some aspects, a naphtha boiling range fuel composition can have a lower final boiling point and/or T95 distillation point, such as a final boiling point and/or T95 distillation point of about 419° F. (−215° C.), or about 400° F. (−204° C.) or less, or about 380° F. (−193° C.) or less, or about 360° F. (−182°

C.) or less. Optionally, a naphtha boiling range fuel composition can have a higher T5 distillation point, such as a T5 distillation point of at least about 15° C., or at least about 20° C., or at least about 30° C. In particular, a naphtha to boiling range fuel composition can have a T5 to T95 distillation point range corresponding to a T5 of at least about 10° C. and a T95 of about 233° C. or less; or a T5 of at least about 15° C. and a T95 of about 215° C. or less; or a T5 of at least about 15° C. and a T95 of about 204° C. or less. In this discussion and the claims below, ASTM D2887 should be used for determining boiling points (including fractional weight boiling points).

In the claims below, unless otherwise specified, all wt % values correspond to wt % relative to a total weight of a naphtha boiling range composition/fuel composition.

Determining Ignition Delay: Octane Number and Compositional Analysis

Conventionally, the ignition delay and/or knocking resistance of a fuel is believed to be correlated with the octane number for a fuel, such as research octane number (RON) or an average of the research octane number and the motor octane number (MON). It has been unexpectedly determined that a superior correlation for ignition delay can be provided by combining RON with compositional analysis, and in particular with the wt % of compounds in a composition that have a straight-chain propyl group.

In this discussion, ignition delays were determined using a Cetane ID 510 constant volume combustion chamber, available from PAC, LP of Houston, Tex. Briefly, during a test of a potential fuel composition, a combustion chamber can be charged with air at a specified pressure. The air in the chamber can then be heated to a desired set point temperature for the test. The chamber can be held at a substantially constant temperature/constant pressure at that point until fuel is introduced into the chamber. Fuel can then be injected into the chamber for a predetermined amount of time, such as an amount of time that corresponds to a desired amount of fuel for injection. An analyzer can measure pressure as function of time after injection of the fuel. Combustion could start during injection, but typically combustion does not start until after completing the injection of the fuel.

In this discussion, ignition delays were determined for various samples at 596° C. and 640° C. Normally ignition delay can be calculated based on the method in ASTM D7668. However, the ignition delay in ASTM D7668 is for determining an ignition delay based on the time required for the pressure to increase to 0.02 MPa above the pressure at injection. This type of ignition delay is relevant to characterization of a fuel performance in a diesel engine. For a spark ignition engine, a more appropriate measure can be the initial heat release ignition delay, which corresponds to the delay in reaching an initial maximum in the dP/dt curve. In the claims below, references to "ignition delay" refer to this ignition delay for initial heat release as determined by the initial local maximum in the dP/dt curve. Because the desired feature of the dP/dt curve is a local maximum, the units associated with the dP/dt curve can be any convenient units. A convenient unit can be to use pressures in MPa and time in milliseconds.

To further illustrate the difference between the ignition delay in ASTM D7668 and the measured ignition delays used herein, FIG. 1 shows an example of a typical pressure versus time curve for iso-octane that was determined using a Cetane ID 510. The curve in FIG. 1 was generated at a temperature of about 600° C., and is representative of pressure versus time curves for iso-octane at 600° C. It is noted that FIG. 1 displays pressure in bars, but it is understood that 1 bar=0.1 MPa. Under the method in ASTM D7668, the ignition delay would be calculated as the time required for the pressure to increase to 0.02 MPa (0.2 bar) above the injection pressure. As shown in FIG. 1, a brief drop in pressure often occurs prior to the pressure increasing to 0.02 MPa above the injection pressure. Under the method in ASTM D7668, the calculated ignition delay for iso-octane at 600° C. was 9.18 milliseconds, based on an average ignition delay over 15 injection runs.

Figure 2:
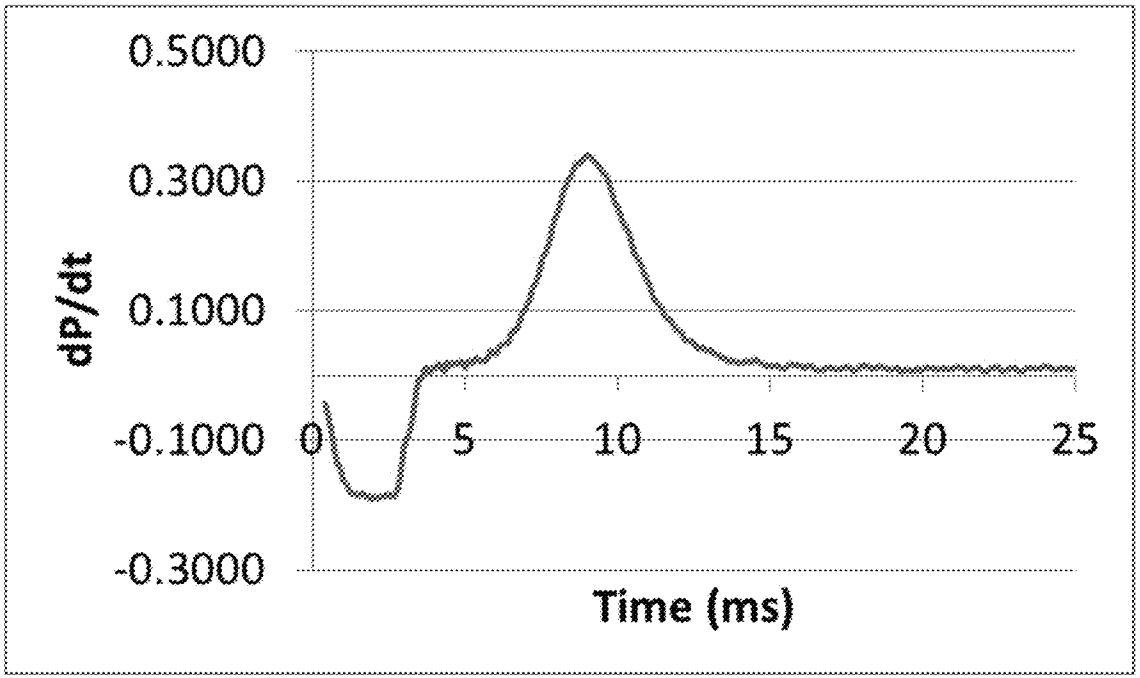
FIG. 2 shows a curve of dP/dt for determining ignition delay based on initial heat release for iso-octane.

In contrast to the method in ASTM D7668, the ignition delays reported herein correspond to the ignition delay for initial heat release, which represents an initial maximum in the derivative of pressure versus time, which can also be referred to as a local maximum in the dP/dt curve. FIG. 2 shows a portion of the average dP/dt curve for the 15 iso-octane injection runs. As for FIG. 1, the pressure for the 15 iso-octane injection runs was measured in bar and the time was measured in milliseconds. The curve shown in FIG. 2 corresponds to the time between 0 and 25 milliseconds. Based on FIG. 2, the ignition delay for initial heat release is 9.06 milliseconds. Although the two separate methods for determining ignition delay provide similar values for iso-octane, for some types of naphtha boiling range samples the separate methods for determining ignition delay can lead to noticeably different values.

Table 3 shows a variety of compositional and characterization data for various naphtha boiling range compositions. Table 3 includes octane number data as well as compositional data related to the content of compounds having straight-chain propyl groups in each composition. For each composition, Table 3 includes RON, MON, AKI (which is computed as [RON+MON]/2), Sensitivity (which is computed as RON−MON), the weight percentage of combined n-paraffins and isoparaffins that have a straight-chain propyl group, and two measured ignition delay values (at 596° C. and 640° C.) based on the ignition delay definition using time of initial heat release during combustion as described above. The $C_{3+}$ concentration values in Table 3 were obtained based on measurements performed on each naphtha boiling range composition listed in Table 3.

TABLE 3

Naphtha Boiling Range Fuel Compositions

| Description | RON | MON | AKI | Sensitivity | $C_{3+}$ wt % | ID596 | ID640 |
|---|---|---|---|---|---|---|---|
| RUL E10 (5 avg) | 90.5 | 81.5 | 86.0 | 9 | 26.1 | 12.48 | 7.72 |
| RUL E10 + 20% MCP | 89.9 | 80.8 | 85 | 9.1 | 19.2 | 14.18 | 8.98 |
| RUL E10 + 40% MCP | 90.4 | 81.2 | 86 | 9.2 | 14.4 | 17.02 | 10.86 |
| PUL E10 | 96.0 | 85.9 | 91.0 | 10.1 | 19.1 | 16.06 | 10.46 |

TABLE 3-continued

| Naphtha Boiling Range Fuel Compositions | | | | | | | |
|---|---|---|---|---|---|---|---|
| Description | RON | MON | AKI | Sensitivity | $C_{3+}$ wt % | ID596 | ID640 |
| PUL E10 + 20% MCP | 94.8 | 84.4 | 90 | 10.4 | 14.9 | 18.78 | 12.46 |
| PUL E10 + 40% MCP | 94.0 | 82.8 | 88 | 11.2 | 9.7 | 21.78 | 13.22 |

The first three rows in Table 3 correspond to fuel compositions with a RON of about 90. The first row in Table 3 corresponds to data for a regular unleaded fuel that contains 10 wt % ethanol. (All wt % values in Table 3 correspond to wt % relative to total weight of fuel.) The second and third rows correspond to mixtures of the regular unleaded fuel combined with 20 wt % or 40 wt % of methylcyclopentane (i.e, final composition is 80 wt % unleaded/20 wt % methylcyclopentane or 60 wt % unleaded/40 wt % methylcyclopentane). It is noted that methylcyclopentane has a RON of about 90 and is a cycloalkane (and therefore is not an n-paraffin or isoparaffin with a straight-chain propyl group). As a result, the compositions corresponding to the first three rows in Table 3 each have a RON value of about 90, a MON value of about 81, and an AKI value of about 85 or 86.

The second group of three compositions in Table 3 corresponds to a premium unleaded fuel that contains 10 wt % ethanol. Similar to the regular unleaded compositions, the first composition corresponds to just the premium unleaded fuel, the second composition corresponds to an 80 wt %:20 wt % mixture of the premium unleaded fuel and methylcyclopentane, and the third composition corresponds to a 60 wt %:40 wt % mixture of the premium unleaded fuel and methylcyclopentane. Due to the higher RON value of the premium unleaded fuel, addition of methylcyclopentane reduces the RON value of the mixtures as shown in Table 3.

The data in Table 3 illustrates how reducing the number of combined n-paraffins and isoparaffins that include a straight-chain propyl group can lead to increased ignition delay. For the first three rows in Table 3 where the RON values of the compositions are roughly constant, addition of increasing amounts of methylcyclopentane results in regular unleaded fuel compositions with increased ignition delay at both ignition delay temperatures. For the regular unleaded fuel mixture including 40 wt % methylcyclopentane, the ignition delay is increased by at least 30% at both ignition delay temperatures relative to the regular unleaded fuel alone, even though a conventional octane test (RON, MON, and/or AKI) would suggest that the ignition delay should be substantially the same for the three fuel composition. This demonstrates the unexpected nature of the finding that controlling the concentration of combined n-paraffins and isoparaffins that include straight-chain propyl groups at a given RON can provide improved control of the ignition delay and/or knock resistance of a naphtha boiling range composition. The second three rows in Table 3 demonstrate a similar result. In particular, even though the addition of methylcyclopentane to the premium unleaded fuel results in a lower RON value, the mixtures including methylcyclopentane unexpectedly have longer ignition delays. Conventionally, it would be expected that lower RON values would correlate with lower ignition delays.

Improved Spark Ignition and Compression Ignition Fuels

Table 3 above demonstrates that using a combination of RON and content of combined n-paraffins and isoparaffins having straight-chain propyl groups can provide a superior way of predicting ignition delay for a fuel, as compared with predictions based on RON and/or MON. Surprisingly, it has also been determined that conventional spark ignition fuel compositions can be characterized as being similar in nature based on RON and content of compounds having straight-chain propyl groups.

Figure 3:
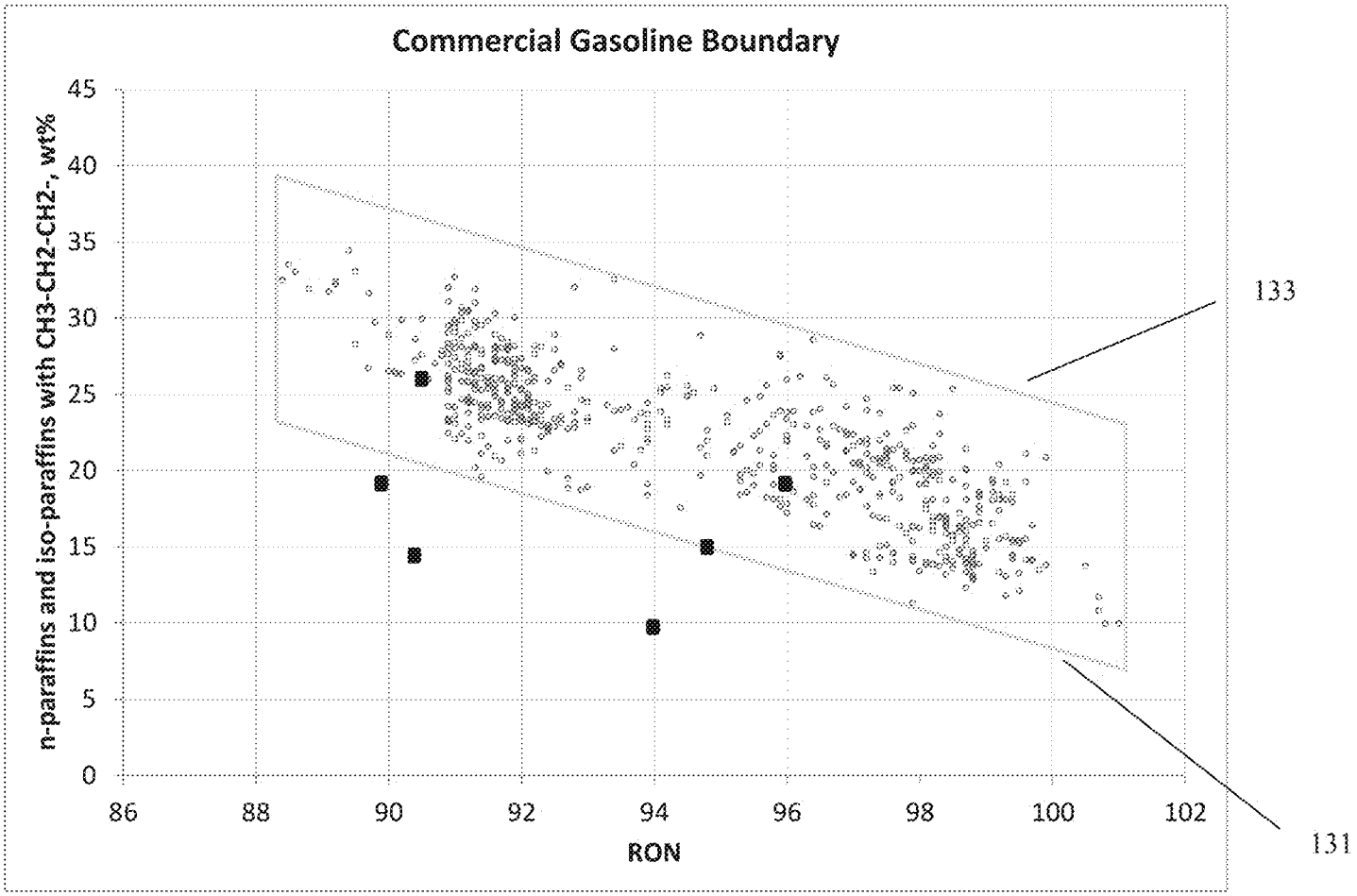
FIG. 3 shows a correlation between research octane number and content of combined n-paraffins and isoparaffins that include straight-chain propyl groups for various fuel compositions.

The distribution of n-paraffins and iso-paraffins containing a straight-chain propyl group ($R_1$—$CH_2$—$CH_2$—$CH_2$—$R_2$) in a large number of commercial unleaded gasolines in the US was determined from detailed chemical composition data that was published at the web domain "IP.com" in 2009. The data consisted of composition analysis and standard fuel properties on 590 randomly selected unleaded gasoline samples collected during January and July in 2008. The subset of the data was from the Southwest Research Institute's monthly gasoline survey of fuel quality sponsored by a consortium of petroleum companies. The results of the composition analysis on the 590 gasoline samples were published as IP.com publication numbers between IPCOM000186445D and IPCOM000187360D. The data summary of the average properties and composition was published in publication number IPCOM000186444D. The description of the data was published in publication number IPCOM000186443D. For each gasoline sample, the published file contains the composition analysis from ASTM D6729-04, Standard Test Method for Determination of Individual Components in Spark Ignition Engine Fuels by 100 Meter Capillary High Resolution Gas Chromatography, identifying up to 610 individual compounds. Based on the identified individual compounds, the n-paraffin and iso-paraffin compounds containing the $R_1$—$CH_2$—$CH_2$—$CH_2$—$R_2$ groups were determined and the wt % of the compounds were summed to determine the total wt % of n-paraffins and iso-paraffins with $R_1$—$CH_2$—$CH_2$—$CH_2$—$R_2$ groups in each fuel. The scatter plot of RON versus wt % of n-paraffin and iso-paraffin compounds that include $R_1$—$CH_2$—$CH_2$—$CH_2$-$R_2$ groups was then generated for all 590 gasoline samples. The scatter plot of RON versus wt % of straight-chain propyl groups in combined n-paraffins and iso-paraffins is shown in FIG. 3. The 590 gasoline samples correspond to the small dots in FIG. 3. FIG. 3 also shows the fuel compositions provided in Table 3, which are shown as the squares. As shown in FIG. 3, the compositions from rows 2, 3, 5, and 6 of Table 3 are located below the bottom edge of the box. It is noted that the composition from row 5 is close to the bottom edge of the box.

Based on the scatter plot shown in FIG. 3, it was surprisingly discovered that the unleaded fuel compositions were strongly similar to each other with regard to the relationship between RON and the weight percent of combined n-paraffins and iso-paraffins having a terminal propyl group. As shown in FIG. 3, all of the unleaded fuel compositions lie within the box shown in FIG. 3. The bottom line 131 of the box in FIG. 3 corresponds to Equation (1) above. Compositions having a content of combined n-paraffins and iso-paraffins that include straight-chain propyl groups that fall below the bottom line 131 of the box in FIG. 3 can have unexpectedly long ignition delays relative to the RON value. The compositions in rows 2, 3, 5, and 6 of Table 3 represent compositions that fall below the bottom line of the box in FIG. 3. Such compositions can be beneficial for use in spark ignition engines. Similarly, the top line 133 of the box in FIG. 3 corresponds to Equation (2) above. Compositions having a content of combined n-paraffins and iso-paraffins with straight-chain propyl groups that fall above the top line 133 of the box in FIG. 3 can have an unexpectedly short ignition delay relative to the RON value. Such compositions can be beneficial for use in compression ignition engines.

Equations (1) and (2), as illustrated in FIG. 3, provide one option for defining fuel compositions having conventional amounts of paraffins with straight-chain propyl groups. FIG. 4 provides another option for such defining such fuel compositions. In FIG. 4, in addition to the box shown in FIG. 3, a second irregular bounding shape is shown for the commercial fuel compositions. The second irregular bounding shape corresponds to the composition ranges specified in Table 1 (bottom portion of shape) and Table 2 (top portion of shape).

Figure 5:
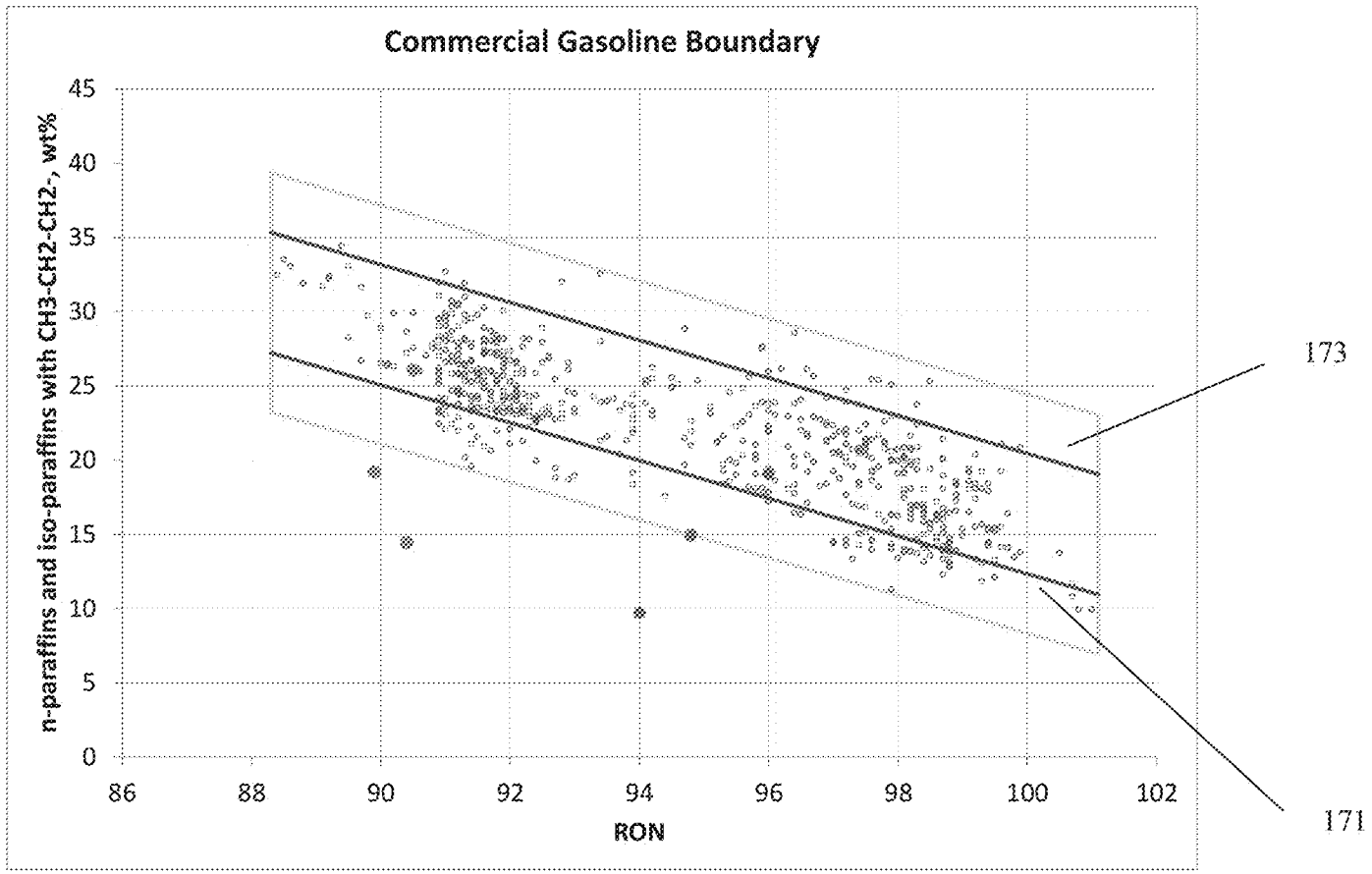
FIG. 5 shows a correlation between research octane number and content of combined n-paraffins and isoparaffins that include straight-chain propyl groups for various fuel compositions.

It is noted that while the box in FIG. 3 includes all of the 590 conventional fuel compositions from the random selection of gasolines, the majority of the fuel compositions are actually located near the center of the box. FIG. 5 shows the data points and box from FIG. 3, but also adds two additional lines to define a smaller box. The additional bottom line 171 and additional top line 173 define a box that includes roughly 90% of the conventional gasoline compositions. The bottom line 171 of the smaller box corresponds to Equation (3), while the top line 173 of the smaller box corresponds to Equation (4).

$$Wt\% \text{ of } (n\text{-paraffins+isoparaffins}) \text{ with straight-chain propyl group} < -1.273 \times \text{RON} + 139.6 \quad (3)$$

$$Wt\% \text{ of } (n\text{-paraffins+isoparaffins}) \text{ with straight-chain propyl group} > -1.273 \times \text{RON} + 147.8 \quad (4)$$

In Equations (3) and (4), wt % is relative to the total weight of a (naphtha boiling range) fuel composition. It is noted that Equation (3) can be used for RON values between about 75 to about 109 or between about 80 to about 109, as opposed to Equation (1), which can be used for RON values between about 80 and about 105. It is noted that Equation (4) can be used for RON values between about 75 to about 110, or about 80 to about 110, or about 75 to about 105, or about 80 to about 105. In some aspects, a fuel composition with increased ignition delay relative to the RON for the fuel composition can be formed by mixing an initial fuel composition with one or more modifier compositions that can reduce the content of combined n-paraffins and iso-paraffins that include straight-chain propyl groups in the fuel composition while maintaining a desired RON value for the composition. Examples of compounds that can be included in a modifier composition for addition to a fuel composition to reduce the content of paraffins and/or isoparaffins that include straight-chain propyl groups include, but are not limited to, aromatic compounds, cycloalkanes, isobutane, methyl-substituted butanes, and isooctane. In some preferred aspects, the modifier composition can reduce the content of combined n-paraffins and iso-paraffins with straight-chain propyl groups while producing a modified fuel with an RON value that differs from the RON of the initial fuel composition by less than 5.0, or less than 3.0, or less than 1.0. In some preferred aspects, the modifier composition can increase the ignition delay of a modified fuel by at least about 1.0 millisecond, or at least about 2.0 milliseconds, relative to the ignition delay of the initial fuel composition while producing a blended fuel with an RON value that differs from the RON of the initial fuel composition by less than 5.0, or less than 3.0, or less than 1.0. The ignition delay can be determined based on the initial heat release ignition delay (local maximum in the dP/dt curve) as described herein. In some aspects, the resulting modified fuel composition can have a combination of RON value and weight percent of combined n-paraffins and iso-paraffins that include straight-chain propyl groups that satisfies Equation (1). In some aspects, the resulting modified fuel composition can have a combination of RON value and weight percent of combined n-paraffins and iso-paraffins that include straight-chain propyl groups that satisfies Equation (3).

In some aspects, a fuel composition with reduced ignition delay relative to the RON for the fuel composition can be formed by mixing an initial fuel composition with one or more modifier compositions that can increase the content of combined n-paraffins and iso-paraffins that include straight-chain propyl groups in the fuel composition while maintaining a desired RON value for the composition. Examples of compounds that can be included in a modifier composition for addition to a fuel composition to increase the content combined n-paraffins and iso-paraffins that include straight-chain propyl groups include, but are not limited to, n-paraffins having 4 or more carbons and isoparaffins that include a straight-chain propyl group (such as 2-methylpentane). In some preferred aspects, the modifier composition can increase the content of combined n-paraffins and iso-paraffins that include straight-chain propyl groups while producing a blended fuel with an RON value that differs from the RON of the initial fuel composition by less than 5, or less than 3, or less than 1. In some preferred aspects, the modifier composition can reduce the ignition delay of a blended fuel by at least about 1.0 milliseconds, or at least about 2.0 milliseconds, relative to the ignition delay of the initial fuel composition while producing a blended fuel with an RON value that differs from the RON of the initial fuel composition by less than 5.0, or less than 3.0, or less than 1.0. The ignition delay can be determined based on the initial heat release ignition delay (local maximum in the dP/dt curve) as described herein. In some aspects, the resulting modified fuel composition can have a combination of RON value and weight percent of combined n-paraffins and iso-paraffins that include straight-chain propyl groups that satisfies Equation (2). In some aspects, the resulting modified fuel composition can have a combination of RON value and weight percent of combined n-paraffins and iso-paraffins that include straight-chain propyl groups that satisfies Equation (4).

Additional Example

Various gasoline samples were developed, analyzed, and tested in an engine test to determine ignition delay and knock resistance relative to octane and composition. Details regarding the gasoline samples are shown in Table 4. The first two samples corresponded to a regular unleaded gasoline containing ~10 vol % ethanol (RUL2) and a premium unleaded gasoline containing ~10 vol % ethanol (PUL2). Fuel 1 corresponded to a blend of roughly 45 vol % of RUL2 with roughly 55 vol % of a mixture of cycloalkanes plus sufficient ethanol so that Fuel 1 contained roughly 10 vol % ethanol. Fuel 2 corresponded to a blend of roughly 50 vol % of PUL2 with a mixture of cycloalkanes, aromatics, and ethanol to achieve the composition shown in Table 4. Fuels 1 and 2 thus corresponded to compositions with a decreased weight percentage of n-paraffins and isoparaffins that included a straight-chain propyl group relative to RUL2 or PUL2, respectively. Fuel 3 corresponded to a blend of RUL2 with a mixture of isoparaffins plus ethanol to achieve the composition shown in Table 4. The isoparaffins included sufficient amounts of straight-chain propyl groups so that the weight percentage of n-paraffins and isoparaffins that included a straight-chain propyl group was increased relative to RUL2. Fuel 4 corresponded to a blend of PUL2 with a mixture of isoparaffins plus ethanol to achieve the composition shown in Table 4. The isoparaffins included sufficient amounts of straight-chain propyl groups so that the weight percentage of n-paraffins and isoparaffins that included a straight-chain propyl group was increased relative to PUL2.

The gasoline samples from Table 4 were tested on the Cetane ID 510 (CID) instrument to measure the ignition delay at 596° C. and 640° C. The samples were also tested in an engine test using a Ford EcoBoost GTDI 2.0 L 4 cylinder engine. The engine was turbocharged with direction injection. The fuels were tested for their knock resistance by running an ignition spark sweep at full load condition at 3000 rpm with an air intake temperature of 45° C. The intake air temperature was increased to make the engine condition more severe for knock. For each fuel, the knock limited spark timing was determined by measuring the frequency of knock at each spark timing. The results of the CID test and the engine test with relevant fuel properties are summarized in Table 5.

TABLE 4

Gasoline Compositions for Characterization

| Method | Description | RUL2 | PUL2 | Fuel 1 | Fuel 2 | Fuel 3 | Fuel 4 |
|---|---|---|---|---|---|---|---|
| D2699 | Research Octane Number | 91.4 | 97.6 | 93.3 | 98.0 | 93.6 | 95.0 |
| D2700 | Motor Octane Number | 83.5 | 89.6 | 88.4 | 86.7 | 86.0 | 88.0 |
| (R + M)/2 | Octane Rating | 87.5 | 93.6 | 89.8 | 92.4 | 89.8 | 91.5 |
| (R − M) | Octane Sensitivity | 7.9 | 8.0 | 4.9 | 11.3 | 7.6 | 7.0 |
| ASTM D4052 | Density @ 15° C,. g/ml | 0.7281 | 0.7147 | 0.7432 | 0.7492 | 0.7249 | 0.7256 |
| ASTM D5453 | Sulphur* mg/kg | 9.1 | 6 | 5.5 | 2.8 | 3.2 | 1.6 |
| ASTM D86 | Initial BP, ° F. | 81.0 | 83.0 | 97.2 | 101.2 | 102.2 | 108.2 |
| ASTM D86 | 5% Evaporated @, ° F. | 97.0 | 99.5 | 121.4 | 123.6 | 122.7 | 125.4 |
| ASTM D86 | 10% Evaporated @, ° F. | 106.6 | 114.0 | 126.4 | 130.9 | 126.4 | 130.0 |
| ASTM D86 | 30% Evaporated @, ° F. | 131.2 | 149.7 | 137.4 | 146.3 | 135.0 | 138.8 |
| ASTM D86 | 50% Evaporated @, ° F. | 151.1 | 209.1 | 146.0 | 160.3 | 141.2 | 148.2 |
| ASTM D86 | 70% Evaporated @, ° F. | 235.9 | 240.8 | 179.9 | 20.3 | 182.0 | 189.1 |
| ASTM D86 | 90% Evaporated @, ° F. | 321.8 | 312.5 | 262.3 | 250.2 | 246.1 | 232.6 |
| ASTM D86 | 95% Evaporated @, ° F. | 353.6 | 356.5 | 317.3 | 300.5 | 281.6 | 242.4 |
| ASTM D86 | Final BP, ° F. | 397.8 | 413.6 | 378.5 | 380.9 | 365.2 | 314.4 |
| ASTM D86 | Residue | 1.1 | 1.1 | 1.1 | 1.0 | 1.0 | 0.9 |
| ASTM D6730 | $R_1$—CH2—CH2—CH2—$R_2$, wt % | 33.0 | 20.1 | 14.6 | 9.2 | 36.0 | 33.2 |
| ASTM D6730 | $R_1$—CH2—CH2—CH2—$R_2$, vol % | 36.1 | 22.3 | 16.5 | 10.7 | 39.3 | 36.6 |
| ASTM D6730 | $R_1$—CH2—CH2—CH2—$R_2$, mol % | 32.0 | 22.7 | 14.1 | 9.6 | 33.9 | 32.1 |
| ASTM D6730 | Ethanol, wt % | 11.8 | 11.6 | 10.1 | 11.3 | 10.5 | 8.9 |
| ASTM D6730 | Ethanol, vol % | 10.5 | 10.2 | 9.4 | 10.6 | 9.4 | 8.1 |
| ASTM D6730 | Paraffins, wt % | 20.3 | 13.1 | 9.2 | 5.8 | 6.0 | 2.6 |
| ASTM D6730 | Iso-Paraffins, wt % | 36.0 | 61.9 | 15.9 | 26.0 | 54.0 | 59.7 |
| ASTM D6730 | Olefins, wt % | 5.5 | 2.0 | 2.4 | 0.9 | 3.0 | 0.6 |
| ASTM D6730 | Napthenes, wt % | 7.9 | 1.6 | 52.6 | 39.8 | 2.6 | 1.4 |
| ASTM D6730 | Aromatics, wt % | 17.0 | 8.7 | 8.8 | 16.0 | 23.3 | 26.4 |
| ASTM D6730 | Total $C_{14+}$, wt % | 0.0 | 0.0 | 0.0 | 0.0 | 0.0 | 0.0 |
| ASTM D6730 | Total Unknowns, wt % | 0.6 | 0.7 | 0.5 | 0.2 | 0.2 | 0.2 |
| ASTM D6730 | Total Oxygenates, wt % | 11.9 | 11.7 | 10.4 | 11.3 | 10.6 | 9.0 |

TABLE 5

Results of CID and Engine Testing

| Method | Description | RUL2 | PUL2 | Fuel 1 | Fuel 2 | Fuel 3 | Fuel 4 |
|---|---|---|---|---|---|---|---|
| D2699 | Research Octane Number | 91.4 | 97.6 | 93.3 | 98.0 | 93.6 | 95.0 |
| D2700 | Motor Octane Number | 83.5 | 89.6 | 88.4 | 86.7 | 86.0 | 88.0 |
| (R + M)/2 | Octane Rating | 87.5 | 93.6 | 89.8 | 92.4 | 89.8 | 91.5 |
| (R − M) | Octane Sensitivity | 7.9 | 8.0 | 4.9 | 11.3 | 7.6 | 7.0 |
| ASTM D6730 | $R_1$—CH2—CH2—CH2—$R_2$, wt % | 33.0 | 20.1 | 14.6 | 9.2 | 36.0 | 33.2 |
| CID | Ignition Delay @ 596° C. | 12.3 | 13.7 | 21.4 | 30.3 | 12.6 | 12.9 |
| Engine Test | Knock Limited* Ignition Timing, ° Crank Angle BTDC | 9 | 11.8 | 11.8 | 15.4 | 9.9 | 11.5 |

As shown in Table 5, the premium unleaded (PUL2) was more knock resistant than the regular unleaded (RUL2), as demonstrated by the ignition timing advance values of 9° for RUL2 versus 11.8° for PUL2. The PUL2 sample also had higher RON, lower weight percent of n-paraffins and isoparaffins containing a straight-chain propyl group, and longer ignition delay.

Modification of a fuel by increasing the weight percentage of cycloalkanes and/or aromatics (and therefore decreasing the weight percentage of n-paraffins and isoparaffins containing a straight-chain propyl group) resulted in a fuel with an unexpectedly increased knock resistance and/or longer ignition delay. Modification of RUL2 resulted in Fuel 1, which unexpectedly had comparable knock resistance to PUL2, in spite of Fuel 1 having an RON that is ~4 lower than the RON for PUL2. It is noted that Fuel 1 had a sufficiently low combined weight percentage of n-paraffins and isoparaffins that include a straight-chain propyl group to a fuel composition according to various embodiments described herein. Similarly, modification of PUL2 resulted in Fuel 2, which had similar RON to PUL2 but an unexpectedly increased knock resistance and/or longer ignition delay. It is noted that Fuel 2 had a sufficiently low combined weight percentage of n-paraffins and isoparaffins that include a straight-chain propyl group to correspond to a fuel composition according to various embodiments described herein.

Modifying RUL2 to have an increase in the combined weight percentage of n-paraffins and isoparaffins that include a straight-chain propyl group resulted in Fuel 3. In contrast to Fuel 1, the modification of RUL2 to produce Fuel 3 resulted in a composition that had a comparable ignition delay to RUL2 but with a slightly higher knock resistance comp. It is noted that the modification to achieve Fuel 3 resulted in a composition that is still within the range of conventional gasolines. Similarly, modifying PUL2 to have an increase in the combined weight percentage of n-paraffins and isoparaffins that include a straight-chain propyl group (Fuel 4) resulted in a composition that had a comparable ignition delay and a comparable knock resistance to PUL2. Fuel 4 also corresponds to a composition that is within the range of conventional gasolines.

ADDITIONAL EMBODIMENTS

Embodiment 1

A naphtha boiling range fuel composition having a research octane number (RON) of about 80 to about 105, the fuel composition comprising a combined wt % of n-paraffins and isoparaffins that include a straight-chain propyl group that is less than (−1.273×RON+135.6) based on the total weight of the fuel composition.

Embodiment 2

A naphtha boiling range fuel composition having a research octane number (RON) of about 80 to about 110, the fuel composition comprising a combined wt % of n-paraffins and isoparaffins that include a straight-chain propyl group that is greater than (−1.273×RON+151.8) based on the total weight of the fuel composition.

Embodiment 3

The fuel composition of any of the above embodiments, wherein the fuel composition has a T5 distillation point of at least about 10° C. and a T95 distillation point of about 233° C. or less, or a T5 of at least about 15° C. and a T95 of about 215° C. or less, or a T5 of at least about 15° C. and a T95 of about 204° C. or less.

Embodiment 4

The fuel composition of any of the above embodiments, wherein the fuel composition has a RON of about 80 to about 99, or about 82 to about 98, or about 84 to about 96, or about 88 to about 101.

Embodiment 5

The fuel composition of any of the above embodiments, wherein a sensitivity (RON−MON) of the fuel composition is about 2 about 18.0, or about 5.0 to about 12.0, or about 5.0 to about 10.0.

Embodiment 6

The fuel composition of any of the above embodiments, wherein the modified naphtha boiling range composition comprises at least about 5 wt % naphthenes, or at least about 10 wt % naphthenes; or wherein the modified naphtha boiling range composition comprises at least about 5 wt % aromatics, or at least about 10 wt % aromatics; or a combination thereof.

Embodiment 7

A method for making a naphtha boiling range composition, comprising: forming a modified naphtha boiling range composition by adding a modifier composition to a first naphtha boiling range composition, the first naphtha boiling range composition having a research octane number (RON) of at least about 80, wherein: an ignition delay of the modified naphtha boiling range composition is greater than an ignition delay of the first naphtha boiling range composition by at least about 1.0 milliseconds (or at least about 2.0 milliseconds), a combined wt % of n-paraffins and isoparaffins that include a straight-chain propyl group in the first naphtha boiling range composition is greater than (−1.273×RON+139.6) based on the total weight of the first naphtha boiling range composition, and the combined wt % of n-paraffins and isoparaffins that include a straight-chain propyl group in the modified naphtha boiling range composition is less than (−1.273×RON+139.6) based on the total weight of the modified naphtha boiling range composition.

Embodiment 8

The method of Embodiment 7, wherein the combined wt % of n-paraffins and isoparaffins that include a straight-chain propyl chain is less than (−1.273×RON+135.6), the modified naphtha boiling range composition having an RON of about 80 to about 105.

Embodiment 9

A method for making a naphtha boiling range composition, comprising: forming a modified naphtha boiling range composition by adding a modifier composition to a first naphtha boiling range composition, the first naphtha boiling range composition having a research octane number (RON) of at least about 80, wherein: an ignition delay of the modified naphtha boiling range composition is greater than an ignition delay of the first naphtha boiling range composition by at least about 1.0 milliseconds (or at least about 2.0 milliseconds), a combined wt % of n-paraffins and isoparaffins that include a straight-chain propyl group in the first naphtha boiling range composition is less than (−1.273×RON+147.8) based on the total weight of the first naphtha boiling range composition, and the combined wt % of n-paraffins and isoparaffins that include a straight-chain propyl group in the modified naphtha boiling range composition is greater than (−1.273×RON+147.8) based on the total weight of the modified naphtha boiling range composition.

Embodiment 10

The method of Embodiment 9, wherein the combined wt % of n-paraffins and isoparaffins that include a straight-chain propyl group is greater than (−1.273×RON+151.8).

Embodiment 11

The method of any of Embodiments 7 to 10, wherein the RON of the to modified naphtha boiling range composition differs from the RON of the first naphtha boiling range composition by 5.0 or less, or 3.0 or less, or 1.0 or less.

Embodiment 12

The method of any of Embodiments 7 to 11, wherein the first naphtha boiling range composition, has a RON of about 80 to about 99, or about 82 to about 98, or about 84 to about 96, about 75 to about 105, or about 88 to about 101; or wherein the modified naphtha boiling range composition, has a RON of about 80 to about 99, or about 82 to about 98, or about 84 to about 96, about 75 to about 105, or about 88 to about 101; or a combination thereof.

Embodiment 13

The method of any of Embodiments 7 to 12, wherein the modified naphtha boiling range composition comprises at least about 5 wt % naphthenes, or at least about 10 wt % naphthenes; or wherein the modified naphtha boiling range composition comprises at least about 5 wt % aromatics, or at least about 10 wt % aromatics; or a combination thereof.

Embodiment 14

The method of any of Embodiments 7 to 13, wherein the first naphtha boiling range composition and/or the modified naphtha boiling range composition has a T5 distillation point of at least about 10° C. and a T95 distillation point of about 233° C. or less, or a T5 of at least about 15° C. and a T95 of about 215° C. or less, or a T5 of at least about 15° C. and a T95 of about 204° C. or less.

Embodiment 15

A modified naphtha boiling range composition made according to any of Embodiments 7 to 14.

Embodiment 16

The method of any of Embodiments 7 to 14, wherein the ignition delay is defined as an initial local maximum in the dP/dt curve generated during constant volume combustion at 596° C. according to the method described in ASTM D7668.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A naphtha boiling range fuel composition having a research octane number (RON) of about 80 to about 105, the fuel composition comprising paraffins, isoparaffins, naphthenes, and aromatics, the fuel composition comprising a combined wt % of n-paraffins and isoparaffins that include a straight-chain propyl group that is less than (−1.273×RON+135.6), based upon the total weight of the fuel composition.

2. The fuel composition of claim 1, wherein the fuel composition has a T5 distillation point of at least about 10° C. and a T95 distillation point of about 233° C. or less.

3. The fuel composition of claim 1, wherein the fuel composition has a RON of about 80 to about 99.

4. The fuel composition of claim 1, wherein the fuel composition has a RON of about 88 to about 101.

5. The fuel composition of claim 1, wherein a sensitivity (RON−MON) of the fuel composition is about 8.0 to about 18.0.

6. A method for making a modified naphtha boiling range composition, comprising:

forming a modified naphtha boiling range composition by adding a modifier composition to a first naphtha boiling range composition, the modifier composition comprising one or more compounds different from n-paraffins and isoparaffins that include a straight chain n-propyl group, the first naphtha boiling range composition having a research octane number (RON) of at least about 80, the modified naphtha boiling range composition having a RON of about 80 to about 109, wherein:

an ignition delay of the modified naphtha boiling range composition is greater than an ignition delay of the first naphtha boiling range composition by at least 1.0 milliseconds, a combined wt % of n-paraffins and isoparaffins that include a straight-chain propyl group in the first naphtha boiling range composition is greater than (−1.273×RON+139.6) based on a total weight of the first naphtha boiling range composition, and a combined wt % of n-paraffins and isoparaffins that include a straight-chain propyl group in the modified naphtha boiling range composition is less than (−1.273×RON+139.6) based on a total weight of the modified naphtha boiling range composition.

7. The method of claim 6, wherein the combined wt % of n-paraffins and isoparaffins that include a straight-chain propyl chain in the modified naphtha boiling range composition is less than (−1.273×RON+135.6), the modified naphtha boiling range composition having a RON of about 80 to about 105.

8. The method of claim 6, wherein the RON of the modified naphtha boiling range composition differs from the RON of the first naphtha boiling range composition by 5.0 or less.

9. The method of claim 6, wherein the first naphtha boiling range composition has a RON of about 80 to about 99; or wherein the modified naphtha boiling composition has a RON of about 80 to about 99; or a combination thereof.

10. The method of claim 6, wherein the modified naphtha boiling range composition has a RON of about 88 to about 101; or wherein the first naphtha boiling range composition has a RON of about 88 to about 101; or a combination thereof.

11. The method of claim 6, wherein the ignition delay is defined as an initial local maximum in the dP/dt curve generated during constant volume combustion at 596° C. according to the method described in ASTM D7668.

12. A naphtha boiling range fuel composition having a research octane number (RON) of about 80 to about 105, the fuel composition comprising paraffins, isoparaffins, naphthenes, and aromatics, the fuel composition comprising a combined wt % of n-paraffins and isoparaffins that include a straight-chain propyl group that, based on the total weight of the fuel composition, is less than the value from Expression 1 for the corresponding RON value of the fuel composition, wherein Expression 1 has the form:

| RON Range | $C_{3+}$ wt % (straight-chain propyl in n-paraffin and isoparaffin) |
|---|---|
| 88.3 <= RON <= 91.4 | $C_{3+}$ wt % < 411.1 − 4.290 × RON (wt % 32.3 − 19.0) |
| 91.4 <= RON <= 96.4 | $C_{3+}$ wt % < 73.8 − 0.600 × RON (wt % 19.0 − 16.0) |
| 96.4 <= RON <= 97.9 | $C_{3+}$ wt % < 350.2 − 3.467 × RON (wt % 16.0 − 10.8) |
| 97.9 <= RON <= 99.5 | $C_{3+}$ wt % < −32.00 + 0.4375 × RON (wt % 10.8 − 11.5) |
| 99.5 <= RON <= 101.1 | $C_{3+}$ wt % < 167.0 − 1.563 × RON (wt % 11.5 − 9.0). |

13. The fuel composition of claim 12, wherein the fuel composition has a T5 distillation point of at least about 10° C. and a T95 distillation point of about 233° C. or less.

14. The fuel composition of claim 12, wherein the fuel composition has a RON of about 80 to about 99, or wherein the fuel composition has a RON of about 88 to about 101.

15. The fuel composition of claim 12, wherein a sensitivity (RON−MON) of the fuel composition is about 8.0 to about 18.0.

16. A method for making a modified naphtha boiling range composition, comprising:

forming a modified naphtha boiling range composition by adding a modifier composition to a first naphtha boiling range composition, the modifier composition comprising one or more compounds different from n-paraffins and isoparaffins that include a straight chain n-propyl group, the first naphtha boiling range composition having a research octane number (RON) of at least about 80, the modified naphtha boiling range composition having a RON of about 80 to about 109, wherein:

an ignition delay of the modified naphtha boiling range composition is greater than an ignition delay of the first naphtha boiling range composition by at least 1.0 milliseconds, a combined wt % of n-paraffins and isoparaffins that include a straight-chain propyl group in the first naphtha boiling range composition is greater than (−1.273× RON+135.6) based on a total weight of the first naphtha boiling range composition, and a combined wt % of n-paraffins and isoparaffins that include a straight-chain propyl group in the modified naphtha boiling range composition is less than (−1.273×RON+135.6) based on a total weight of the modified naphtha boiling range composition.

17. The method of claim 16, wherein the ignition delay is defined as an initial local maximum in a dP/dt curve generated during constant volume combustion at 596° C. according to the method described in ASTM D7668.

18. The method of claim 16, wherein the RON of the modified naphtha boiling range composition differs from the RON of the first naphtha boiling range composition by 5.0 or less.

19. The method of claim 16, wherein the first naphtha boiling range composition has a RON of about 80 to about 99; or wherein the modified naphtha boiling composition has a RON of about 80 to about 99; or a combination thereof.

20. The method of claim 16, wherein the modified naphtha boiling range composition has a RON of about 88 to about 101; or wherein the first naphtha boiling range composition has a RON of about 88 to about 101; or a combination thereof.

* * * * *